US008479321B2

(12) United States Patent
Razzaghi et al.

(10) Patent No.: US 8,479,321 B2
(45) **Date of Patent: *Jul. 9, 2013**

(54) SUSPENDERS

(75) Inventors: Ali Razzaghi, New York, NY (US); Eric Fehlberg, Queens, NY (US); Caleb Crye, Brooklyn, NY (US); Gregg Thompson, Brooklyn, NY (US)

(73) Assignee: Lion Apparel, Inc., Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/336,763

(22) Filed: Dec. 23, 2011

(65) Prior Publication Data

US 2012/0102624 A1 May 3, 2012

Related U.S. Application Data

(63) Continuation of application No. 11/333,851, filed on Jan. 18, 2006, now Pat. No. 8,104,100.

(60) Provisional application No. 60/671,424, filed on Apr. 14, 2005.

(51) Int. Cl.
*A41F 19/00* (2006.01)

(52) U.S. Cl.
USPC ..... 2/327

(58) Field of Classification Search
USPC ..... 2/79, 227, 329, 326, 327, 328, 336, 2/310, 340
See application file for complete search history.

(56) References Cited

U.S. PATENT DOCUMENTS

| | | | | | |
|---|---|---|---|---|---|
| 3,484,870 | A | * | 12/1969 | Tempelhof | 2/227 |
| 4,473,614 | A | * | 9/1984 | Hockmeyer | 442/238 |
| 4,481,682 | A | * | 11/1984 | Hall | 2/326 |
| 4,888,830 | A | * | 12/1989 | Putnam | 2/327 |
| 4,922,552 | A | * | 5/1990 | Grilliot et al. | 2/93 |
| 4,967,421 | A | * | 11/1990 | Grilliot et al. | 2/327 |
| RE34,094 | E | * | 10/1992 | Grilliot et al. | 2/327 |
| 5,165,110 | A | * | 11/1992 | Grilliot et al. | 2/93 |
| 5,168,582 | A | * | 12/1992 | Aldridge | 2/305 |
| 5,319,806 | A | * | 6/1994 | Hermann et al. | 2/461 |
| 5,515,543 | A | * | 5/1996 | Gioello | 2/69 |
| 5,611,079 | A | * | 3/1997 | Bain, III | 2/455 |
| 5,617,581 | A | * | 4/1997 | Robbins | 2/69 |
| 5,628,063 | A | * | 5/1997 | Reed | 2/22 |
| 5,691,028 | A | * | 11/1997 | Curtis | 428/101 |
| 5,729,832 | A | * | 3/1998 | Grilliot et al. | 2/23 |
| 5,791,538 | A | * | 8/1998 | Bain, III | 224/663 |
| 5,806,095 | A | * | 9/1998 | Cotten | 2/79 |
| 8,104,100 | B2 | * | 1/2012 | Razzaghi et al. | 2/327 |

* cited by examiner

*Primary Examiner* — Tejash Patel
(74) *Attorney, Agent, or Firm* — Thompson Hine L.L.P.

(57) ABSTRACT

Suspenders have a generally U-shaped or V-shaped padded connector that has a base portion with first and second legs extending therefrom. The first and second legs of the padded connector are configured to be located on respective shoulders of a wearer, and the base portion configured to lie on a back of a wearer and is shaped and sized to align with the center of the back of the wearer when the suspenders are worn. The suspenders also include a first front strap portion connected to the first leg, a second front strap portion connected to the second leg, and a first and second rear strap portions connected to the base portion of the padded connector. The first and second rear strap portions are spaced apart from and arranged generally parallel to each other when the suspenders are worn.

21 Claims, 6 Drawing Sheets

SUSPENDERS

This application is a continuation of U.S. application Ser. No. 11/333,851, filed Jan. 18, 2006, which claims the benefit of U.S. Provisional Application Ser. No. 60/671,424, filed Apr. 14, 2005, the entire contents of which are hereby incorporated by reference.

TECHNICAL FIELD

This application is directed to suspenders, and more particularly, to suspenders for use with protective garments.

BACKGROUND

Protective or hazardous duty trousers are used in a variety of industries and settings to protect the wearer from hazardous conditions such as heat, smoke, cold, sharp objects, chemicals, liquids, fumes and the like. Such trousers should properly fit and conform to the wearer's body to ensure proper protection. For example, protective trousers should be long enough to ensure complete coverage and protection, but should not be so long as to present a tripping hazard. Furthermore, the trousers should not impede the climbing and walking of the wearer, and should be retained in the proper position.

In order to ensure a proper fit and positioning, suspenders may be used with the protective trousers. The suspenders may include straps that attach to the protective trousers and extend over a wearer's shoulders. The suspenders may provide additional support to the trousers while allowing a user to adjust the height of the trousers relative to the wearer's body. Furthermore, suspenders may allow a wearer to quickly put on and take off the protective trousers.

Many existing suspenders may present various problems and disadvantages. For example, existing suspenders may be difficult and time consuming to attach to, and detach from, the trousers. Furthermore, firefighters and other emergency personnel may use the protective trousers in combination with a tank, such as a self contained breathing apparatus ("SCBA") tank worn on the wearer's back. However, existing protective trousers and suspenders may not provide cushioning and protection from such tanks.

Accordingly, there is a need for suspenders that may be quickly and easily attached to and detached from a protective garment. There is also a need for suspenders that provide protection to a wearer's back.

SUMMARY

In one embodiment, the present invention is a pair of suspenders that can be quickly and easily attached to and detached from a protective garment. In particular, in one embodiment the invention is a suspenders assembly including a pair of suspenders having a pair of front strap portions configured to be coupled to a front portion of a pair of trousers and a pair of rear strap portions configured to be coupled to a rear portion of the pair of trousers. The assembly further includes an attachment tab, wherein both of the rear strap portions or both of the front strap portions are both directly and permanently coupled to the attachment tab. The attachment tab includes a portion of hook-and-loop fastening material located thereon.

In another embodiment the invention is a suspenders assembly including a pair of suspenders including a pair of front strap portions and a pair of rear strap portions. The assembly further includes a pair of trousers, wherein the front strap portions are directly attached to a front portion of the trousers and the rear strap portions are directly attached to a rear portion of the trousers. At least one of the front strap portions or the rear strap portions is coupled to the trousers by hook-and-loop fastening material.

In another embodiment, the invention is a pair of suspenders that provide protection, in the form of padding, to a wearer's back. More particularly, in one embodiment the invention is a suspenders assembly including a pair of suspenders having a pair of front strap portions configured to be coupled to a pair of trousers and a pair of rear strap portions configured to be coupled to the pair of trousers. The suspenders further include a padded portion coupled to an extending between the rear strap portions. The padded portion is configured and located to lie on a wearer's back when the suspenders are worn over the shoulder of a wearer, the padded portion having a greater padding than the strap portion.

Other embodiments of the present invention will be apparent from the following description, the accompanying drawings and the claims.

DETAILED DESCRIPTION

Figure 1:
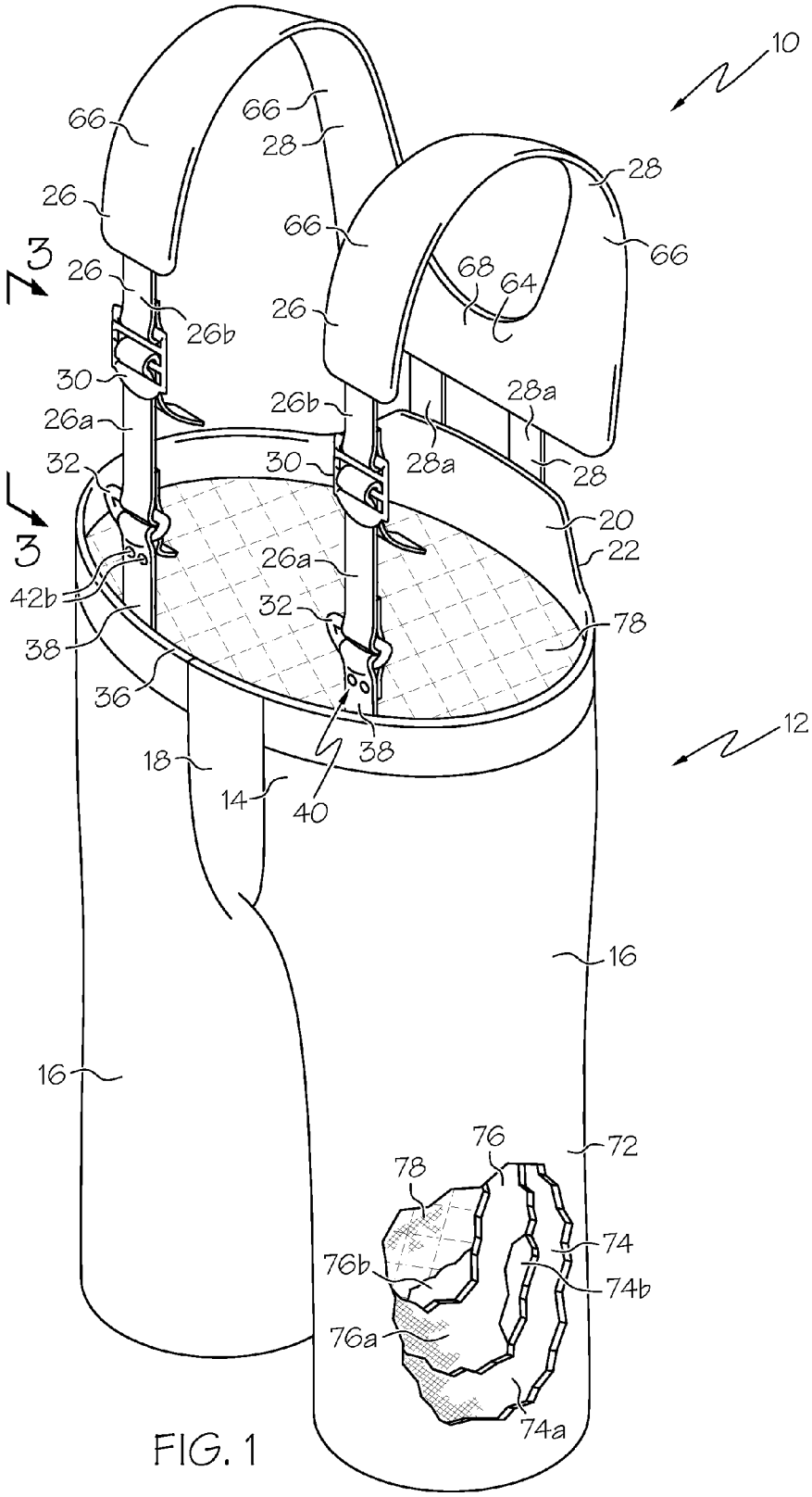
FIG. 1 is a front perspective view of one embodiment of the suspenders of the present invention, shown attached to a pair of trousers, with a portion of the trousers being cut away to illustrate the various layers thereof.

As shown in FIG. 1, one embodiment of the suspenders of the present invention, generally designated 10, are configured to be coupled to a pair of trousers 12. The trousers 12 may have a torso portion 14 configured to receive the lower torso of a wearer, and a pair of legs 16 extending downwardly from the torso portion 14. The trousers 12 may include a front portion 18 and a rear portion 20. The rear portion 20 may include a raised panel 22 to provide additional protection to the back of the wearer.

When worn, the suspenders 10 are configured to fit about the shoulders of a wearer 24 (see FIG. 5) to support and position the trousers 12 in the well known manner of suspenders. In the illustrated embodiment the suspenders 10 includes a pair of front straps or strap portions 26 (that extend from the top of the shoulders of a wearer to the top of trousers 12 along the front of a wearer), and a pair of rear straps or strap portions 28 (that extend from the top of the shoulders of a wearer to the top of the trousers 12 along the back of a wearer). As will be described in greater detail below, in the illustrated embodiment each front strap 26 may include or be formed of various portions, such as front strap portions 26*a*, 26*b*, portions 66 of a padded connector 64, and/or strips of material 38. Each rear strap 28 may include or be formed of a rear strap portion 28*a*, base 68 and/or portions 66 of the padded connector 64.

Both front straps 26 are configured to be directly coupled to the front portion 18 of the pair of trousers 12, and both rear straps 28 are configured to be directly coupled to the rear portion 22 of the trousers 12. Thus a distal end of each front strap 26 is spaced away from, and is not directly coupled to, a distal end of any of said rear straps 28.

Figure 3:
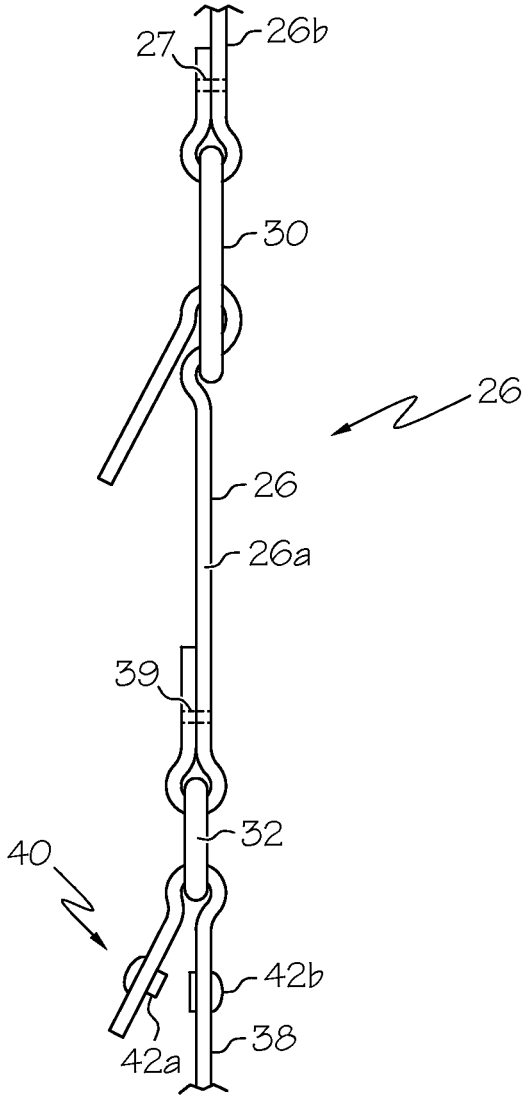
FIG. 3 is a side view of a connector of the suspenders and trousers of FIG. 1.

Each front strap 26 may be made of or include two front strap portions 26*a*, 26*b*, with the front strap portions 26*a*, 26*b* being joined by a buckle 30. The strap portion 26*b* is wrapped around the buckle 30 and coupled to itself by, for example, stitching 27 (see FIG. 3). Strap portion 26*a* is threaded through the buckle 30 such that the effective length of each front strap 26 can be adjusted by threading or unthreading the strap portion 26*a* through the buckle 30.

In the illustrated embodiment each front strap portion 26*a* has a connector 32 located at a lower or distal end thereof, with each connector 32 in the form of a generally D-shaped bracket in the illustrated embodiment. Each front strap portion 26*a* is wrapped around the straight portion of the associated connector 32 and coupled to itself by, for example, stitching 39 (see FIG. 3). Each connector 32 is configured to cooperate with a corresponding coupling component on the trousers 12 to mechanically couple each front strap 26 to the upper portion front portion 18 (for example, the upper edge, belt line 36 or adjacent thereto) of the trousers 12.

Each connector 32 is configured to mechanically engage the trousers 12. For example, in the illustrated embodiment a pair of strips of material 38 are coupled to the upper edge 36 of the trousers 12, such as by stitching. Each strip of material 38 includes a coupling component 40 in the form of two snap connectors 42 located thereon. Each snap connector 42 includes a first snap connector portion 42*a* (i.e. a male snap connector portion) and a second snap connector portion 42*b* (i.e. a female snap connector portion) located thereon. In order to couple each connector 32 (and therefore each front strap 26) to the trousers 12, each strip of material 38 is threaded through the corresponding connector 32. The snap portions 42*a*, 42*b* are then engaged to releasably secure each strip 38 to itself.

Of course, various other connectors could be located on the strips 38 to couple each strip to itself. If addition, the connectors 40 need not necessarily include the brackets 32 and/or strip 38 with snaps, and could take any of a wide variety of forms, including but not limited to hooks, brackets, clasps, clips, ties, buttons, snaps, zippers, slide fasteners, hook-and-loop fastening material (such as VELCRO®), interengaging geometries, and the like. As noted above, the strips 38 could be considered to form part of the front straps 26, rather than part of the trousers 12. However, because the strips 38 may be permanently coupled to the trousers, the strips 38 may more typically be considered as part of the trousers 12 and may be made of the same material as the trousers 12.

The rear straps 28 are configured to be coupled to the rear portion 20 of the trousers 12 and the upper portions thereof may be spaced away from each other at an angle to form a generally "V" shape when worn. Each rear strap 28 may be generally parallel and spaced apart from each other, and may be coupled, at their lower ends, to a generally flat, planar, attachment tab 46 (see FIGS. 2 and 4). Each rear strap 28 may be permanently and directly coupled to the attachment tab 46, such as by stitching, adhesives or the like. The attachment tab 46 has a pair of opposed surfaces 48, 50 and may be made of or include a hook-and-loop fastening material (such as VELCRO®), and/or may have hook-and-loop fastening material on both surfaces 48, 50 thereof. Both surfaces 48, 50 of the attachment tab 46 may be made of or include loop material, or both surfaces 48, 50 may be made of or include hook material, or, if desired, one surface 48, 50 may be made of loop material and the other surface 48, 50 may be made of hook material. The entirety of each surface 48, 50, or at least the majority of each surface 48, 50, may be made of or covered by hook-and-loop fastening material to provide increased coupling ability.

The attachment tab 46 may have a variety of sizes and shapes. For example, in the illustrated embodiment the attachment tab 46 is generally rectangular with a width (i.e. in a direction extending generally horizontally across the body of a wearer 24) of at least about two inches, or at least about four inches, or at least about six inches. The attachment tab 46 may have a height (i.e. generally perpendicular to the width) of at least about one inch, or at least about three inches, or at least about four inches. The attachment tab 46 may have a surface area of at least about 10 square inches, or 20 square inches, or 30 square inches, or other surface areas as can be calculated using the dimensions above.

The rear portion 20 of the trousers 12 may have a coupling portion 54 including a pair of patches 56, 58 of hook-and-loop fastening material. Both patches 56, 58 may have about the same size and shape, and may be permanently coupled to the trousers 12, such as by stitching, adhesives or the like. Both patches 56, 58 may have about the same size and shape as the attachment tab 46, but may be slightly larger than the attachment tab 46 to provide flexibility in the locations in which the attachment tab 46 can be received. The lower edge of patch 58 may be pivotally coupled to the trousers 12 such that patch 58 is movable or pivotable about hinge line 60.

Figure 2:
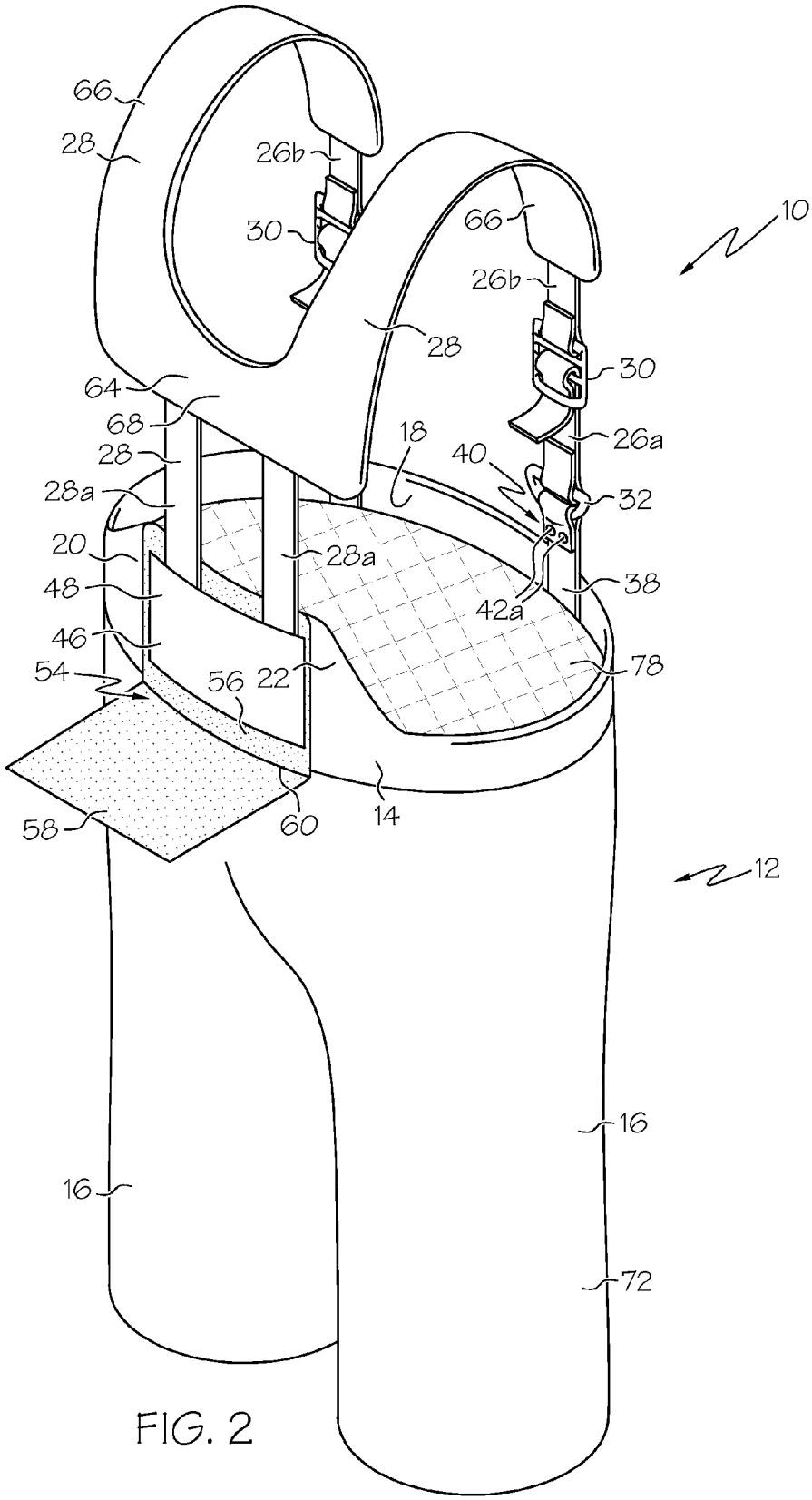
FIG. 2 is a rear perspective view of the suspenders and trousers of FIG. 1.
Figure 4:
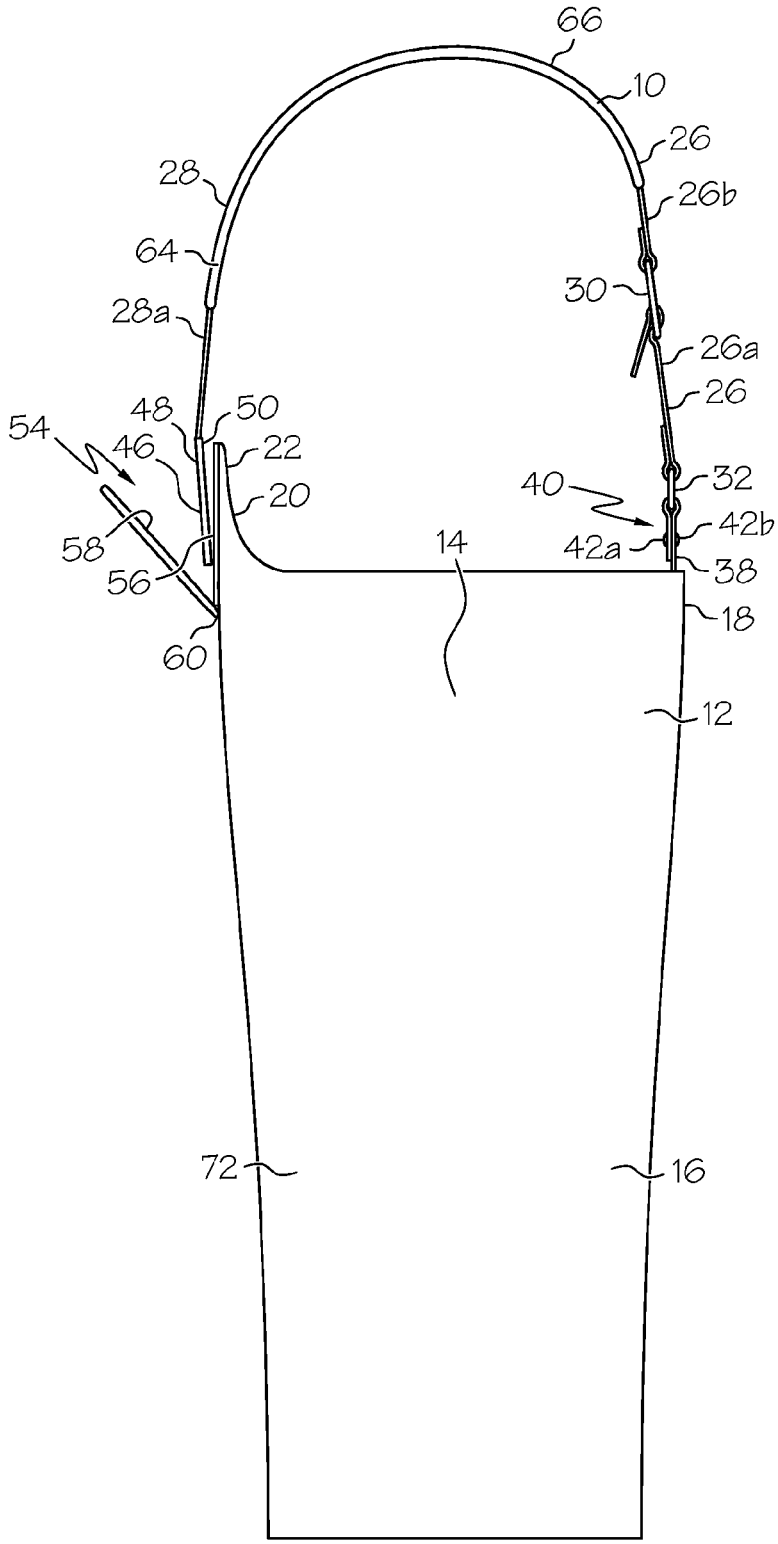
FIG. 4 is a side view of the suspenders and trousers of FIG. 1, with the attachment flap pivoted open.

In order to couple the suspenders 10 to the coupling portion 54, the patches 56, 58 of hook-and-loop fastening material of the coupling portion 54 are first separated, as shown in FIGS. 2 and 4 (i.e. by pivoting the patch 58 about its fold line 60). Next, the attachment tab 46 of the suspenders 10 is positioned between the patches 56, 58. Patch 58 is then pivoted about its hinge line 60 to bring the patch 58 into contact with the tab 46 and press the tab 46 into contact with patch 56. All of the portions of hook-and-loop fastening material 48, 50, 56, 58 are thereby pressed into contact to ensure that the attachment tab 46 is securely gripped in the coupling portion 54. Because the attachment tab 46 is coupled on both sides 48, 50, and has a relatively large surface area, a strong and secure attachment is provided.

The strong and secure attachment may allow a user to position the attachment tab 46 in various positions; i.e. in positions in which a portion of the attachment tab 46 protrudes upwardly from the coupling portion 54. In other words, the attachment tab 46 may be able to be positioned at various vertical positions to provide a crude height adjusting feature to the suspenders 10. In addition, because both rear straps 28 are coupled to the tab 46, both rear straps 28 can be quickly and easily simultaneously coupled to, and uncoupled from the trousers 12 with a single step. This can be important as time can be of the essence in fire rescue and hazardous material situations, in both donning and doffing the trousers 12.

In one embodiment, the portions of hook-and-loop fastening material 48, 50, 56, 58 may be configured such that the attachment tab 46 can be properly secured in the coupling portion 54 in only a single orientation (i.e. when facing the proper direction) to ensure proper mounting of the suspenders 10. In another embodiment the portions of hook-and-loop fastening material 48, 50, 56, 58 may be configured such that the attachment tab 46 can be properly secured in the coupling portion 54 in any orientation (i.e. when facing either direction) to provide flexibility and ease of use.

Figure 6:
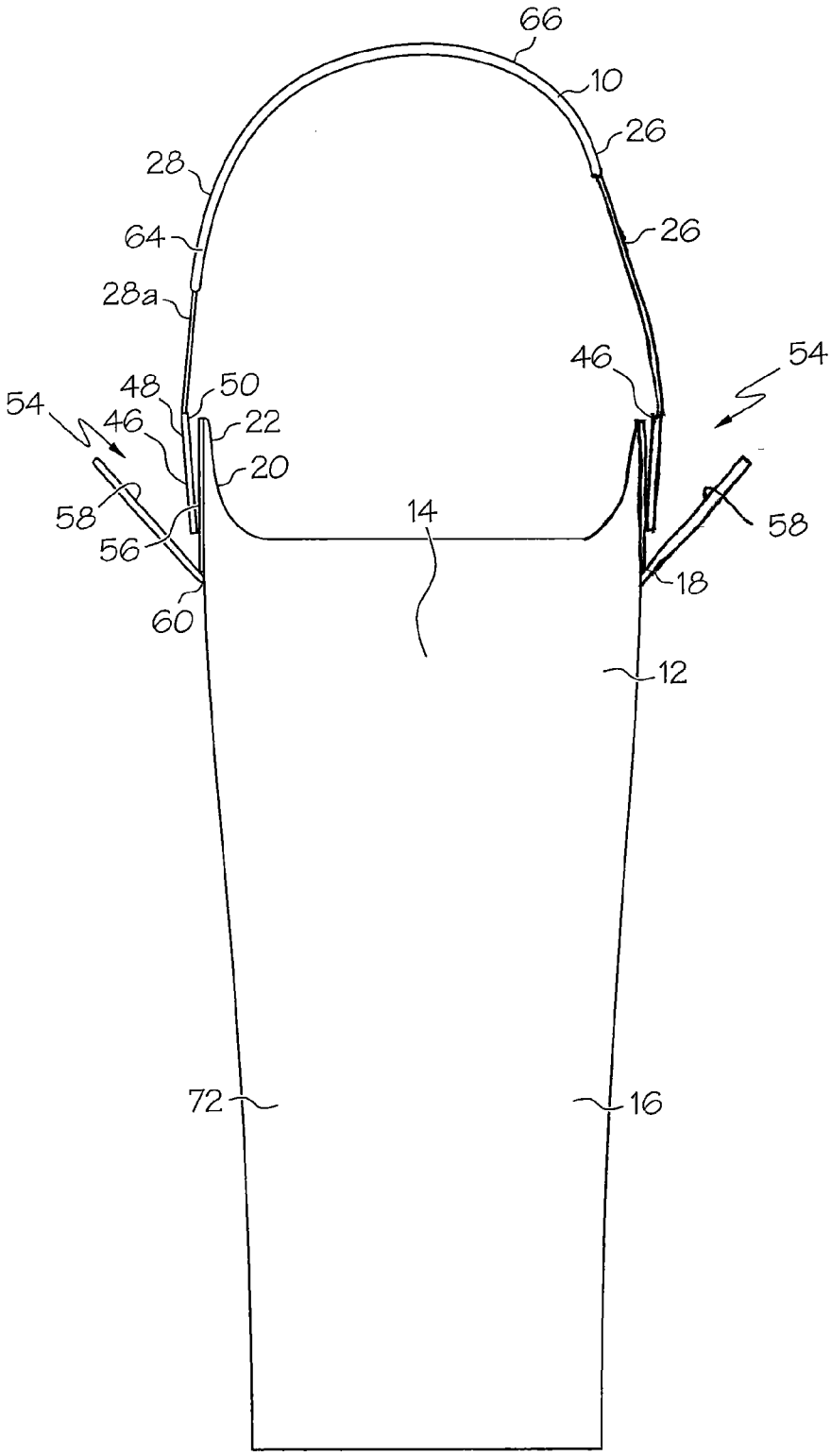
FIG. 6 is a side view of an alternate embodiment of suspenders and trousers with a front and a back attachment flap pivoted open.

If desired, as illustrated in FIG. 6, the coupling portion 54/tab 46 may also or instead be used to attach the front straps 26 to the front of the trousers 12, in which case the coupling portion 54/tab 46 could replace the connectors 32. In addition, if desired, patch 58 of the hook-and-look fastening material may not be utilized, in which case only the patch 56 may attach the suspenders 10 to the trousers 12. Alternately, patch 56 may be omitted and patch 58 may be used alone.

The suspenders 10 may include a generally horizontally-extending padded connector portion 64 located between and/or forming part of the rear straps 28 or front straps 26. The padded connector portion 64 may be generally "U" shaped in front view having a pair of legs 66 and a base portion 68 extending between the legs 66. Each leg 66 may be or form part or a portion of the front and/or rear straps 26, 28. The base portion 68 may be directly coupled to the upper ends of each rear strap portion 28*a*, such as by stitching, adhesives or the like. Alternately, the upper ends of each rear strap portion 28*a* may be received inside the connector portion 64. Similarly, the upper end of each front strap portion 26*b* may be directly coupled to an associated ones of the legs 66, such as by stitching, adhesives or the like, or the front strap portion 26*b* may be received inside the associated leg 66.

If desired, each front strap portion 26*b* and an associated rear strap portion 28*a* may be formed of a single strap or single continuous piece of material that passes through the connector portion 64. In this case, that single piece of material could be freely slidable within the connector portion 64, or could be coupled to the connector portion 64 such that the single piece of material is not slidable relative to the connector portion 64. Of course, if desired, each strap portion 28*a*, 26*b* can be a separate piece of material that is coupled to the connector portion 64, such as by stitching, adhesives or the like.

The strap portions 26*a*, 26*b*, 28*a* may be made from a relatively thin, strap-like fabric material. In one embodiment, the strap portions 26*a*, 26*b*, 28*a* may be made from an elastic material, such as non-elastic fibers interwoven with elastic fibers. Alternately, the strap portions 26*a*, 26*b*, 28*a* are made from a generally non-elastic material, such as nylon. If desired the strap portions 26*a*, 26*b*, 28*a* and connector portion 64 may be made from a durable and fire-resistant material.

The connector portion 64 may be made from a fabric material and may include a padding material attached thereto or contained therein. The connector portion 64 may be, for example a woven fire-resistant fabric material with an inner cavity. A padding material may be located therein, which can be or include, without limitation, foam such as closed cell foam, open cell foam, silicon foam, BASOTECT™ foam (a trademark of BASF Aktiengesellshaft), elastic or polymeric material, air pockets, rubber, aramid materials, or other like material capable of absorbing and/or cushioning an impact. The connector portion 64 may have more padding as compared to the strap portions 26*a*, 26*b*, 28*a*. In addition, the connector portion 64 may have a thickness, in its uncompressed state, of at least about 1/16 inch, or at least about 1/8 inch. The connector portion 64 may have a surface area of at least about 0.01 square feet, or at least about four square inches, or at least about nine square inches, or at least about sixteen square inches, or at least about twenty-five square inches, or at least about thirty-six square inches, to provide sufficient cushioning (i.e., from a tank 70).

Figure 5:
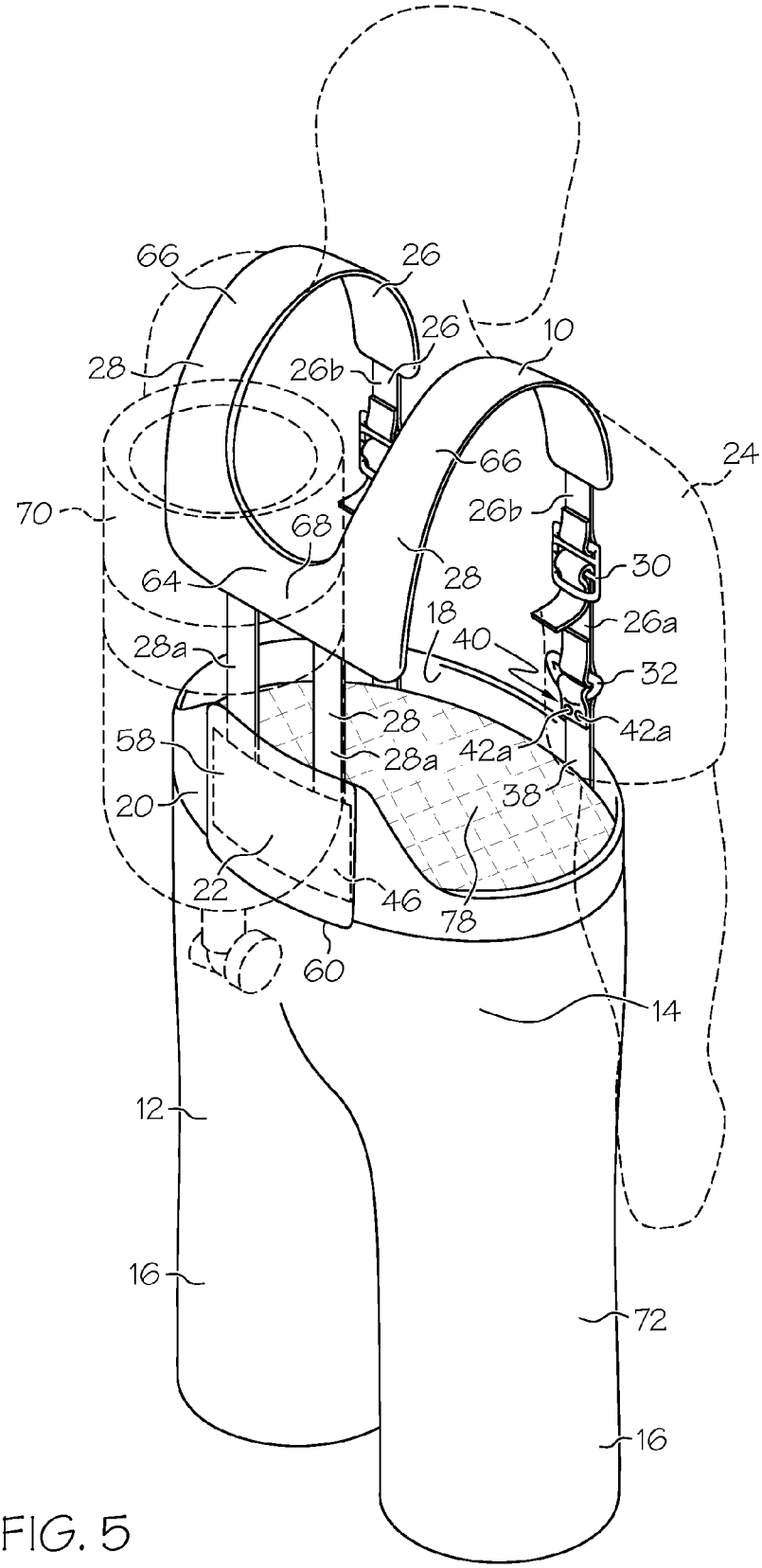
FIG. 5 is a rear perspective view of the trousers and suspenders of FIG. 1, with a wearer and a gas canister shown in hidden lines.

The base portion 68 secures the rear straps 28 together to ensure that they remain aligned and properly positions. In addition, base portion 68/connector portion 64 may be shaped and sized to align with the center of a wearer's back. In particular, the padded connector portion 64 may have a surface area (as outlined above) sufficient to cover and protect a significant portion of a wearer's back. When used in firefighting and other hazardous conditions, a wearer may wear or carry a compressed gas tank, a SCBA tank 70 or the like, as shown in FIG. 5. Such tanks 70 are typically carried on the wearer's back in a back-pack style carrying arrangement. Thus, the connector portion 64 provides additional padding or other shock-absorbent material to absorb the impact of a tank 70 worn on the wearer's back. The padding provided by the connector portion 74 can be of particular importance since movement of the wearer, including walking, running, kneeling, standing, etc. can cause the tank 70 to "bounce" on the wearer's back. Thus the connector portion 64 provides padding, protection and comfort to the wearer.

The trousers 12 may be constructed from a durable and fire-resistant material, as will now be described to greater detail. However, the suspenders 10 of the present invention may be used with various types of garments, and are not necessarily limited to use with such protective garments. In one embodiment, the trousers 12 may include various layers through its thickness to provide various heat, moisture and abrasion resistant qualities to the trousers 12 so that the trousers 12 may be used as a protective, hazardous duty, or firefighter garment. For example, as shown in FIG. 1, the trousers 12 may include an outer shell 72, a moisture barrier 74 located inside of and adjacent to the outer shell 72, a thermal liner or barrier 76 located inside of and adjacent to the moisture barrier 74, and an inner liner or face cloth 78 located inside of and adjacent to the thermal liner 76.

The outer shell 72 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Del.), and commercially available polybenzamidazole fibers include PBI fibers (a trademark of Celanese Corp. of Charlotte, N.C.). Thus, the outer shell 72 may be an aramid material, a blend of aramid materials, a polybenzamidazole material, a blend of aramid and polybenzamidazole materials, or other appropriate materials. The materials of the outer shell 72 may have a weight of, for example, between about six and about ten oz/yd$^2$. The strap portions 26*a*, and/or strap 38, 26*b*, 28*a* and/or outer layers of the connector portion 64 can be made of the same materials as the outer shell 72.

The moisture barrier 74 and thermal liner 76 may be generally coextensive with the outer shell 72, or spaced slightly inwardly from the outer edges of the outer shell 72 to provide moisture and thermal protection throughout the trousers 12. The moisture barrier 74 may include a semi-permeable membrane layer 74*a* and a substrate 74*b*. The membrane layer 74*a* may be generally moisture vapor permeable but generally impermeable to liquid moisture.

The membrane layer 74*a* may be made of or include expanded polytetrafluoroethylene ("PTFE") such as GORE-TEX or CROSSTECH materials (both of which are trademarks of W.L. Gore & Associates, Inc. of Newark, Del.), polyurethane-based materials, neoprene-based materials, cross-linked polymers, polyamid, or other materials. The membrane layer 74*a* may have microscopic openings that permit moisture vapor (such as water vapor) to pass therethrough, but block liquids (such as water) from passing therethrough. The membrane layer 74*a* may be made of a microporous material that is either hydrophilic, hydrophobic, or somewhere in between. The membrane layer 74*a* may also be monolithic and may allow moisture vapor transmission therethrough by molecular diffusion. The membrane layer 74*a* may also be a combination of microporous and monolithic materials (known as a bicomponent moisture barrier), in which the microporous or monolithic materials are layered or intertwined.

In the illustrated embodiment, the membrane layer 74*a* is bonded or adhered to a substrate 74*b* of a flame and heat resistant material to provide structure and protection to the membrane layer 74. The substrate 74*b* may be or include aramid fibers similar to the aramid fibers of the outer shell 72, but may be thinner and lighter in weight. The substrate 74*b* may be woven, non-woven, spunlace or other materials. In the illustrated embodiment, the membrane layer 74*a* faces the outer shell 72. However, the orientation of the moisture barrier 74 may be reversed such that the substrate 74*b* faces the outer shell 72.

The thermal liner 76 may be made of any suitable material that provides sufficient thermal insulation. In one embodiment, the thermal liner 76 may include a relatively thick (i.e. between about 1/16"-3/16") batting, felt or needled non-woven material 76*a* which can include aramid fiber batting (such as NOMEX batting), aramid needlepunch material, an aramid non-woven material, an aramid blend needlepunch material, an aramid blend batting material, an aramid blend non-woven material, or foam (either open cell or closed cell) materials. The batting 76*a* may be configured to trap air and possess sufficient loft to provide thermal resistance to the trousers 12.

The batting 76*a* is typically quilted to the face cloth 76*b*, which can be a weave of a lightweight aramid material. Thus, either the batting 76*a* alone, or the batting 76*a* in combination with the face cloth 76*b*, may be considered to be the thermal liner 76. In one embodiment, the thermal liner 76 may have a thermal protection performance ("TPP") of at least about twenty, or of at least about thirty-five. If desired, the thermal liner 76 may be treated with a water-resistant material.

Although the moisture barrier 74 is shown as being located between the outer shell 72 and the thermal liner 76, the positions of the moisture barrier 74 and thermal liner 76 may be reversed such that the thermal liner 76 is located between the outer shell 72 and the moisture barrier 74. The face cloth 78 may be the innermost layer of the trouser 12, and can provide a comfortable surface for the wearer and protect the thermal liner 76 and/or moisture barrier 74 from abrasion and wear.

Each layer of the trousers 12, and the trousers 12 as a whole, as well as the suspenders 10, may meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, the outer shell 72, moisture barrier 74 and thermal liner 76 of the trousers 12 must be able to resist igniting, burning, melting, dripping and/or separation at a temperature of 500° F. for at least five minutes. Furthermore, in order to meet the NFPA standards, all combined layers of the trousers 12 must provide a thermal protective performance rating of at least thirty-five.

Although the invention is shown and described with respect to certain embodiments, it is obvious that modifications will occur to those skilled in the art upon reading and understanding the specification, and the present invention includes all such modifications.

What is claimed is:

1. Suspenders comprising:

a generally U-shaped or V-shaped padded connector comprising a base portion having first and second legs extending therefrom, the first and second legs being configured to be located on respective shoulders of a wearer and the base portion being configured to lie on a back of a wearer and shaped and sized to align with the center of the back of the wearer when the suspenders are worn;

a first front strap portion coupled to the first leg of the padded connector;

a second front strap portion coupled to the second leg of the padded connector; and first and second rear strap portions coupled to the base portion of the padded connector, the first and second rear strap portions being spaced apart from and arranged generally parallel to each other when the suspenders are worn.

2. The suspenders of claim 1 wherein the padded connector includes a fire resistant material with an inner cavity having the padding material therein.

3. The suspenders of claim 1 wherein the padding material is attached to the padded connector.

4. The suspenders of claim 1 wherein the padded connector has a thickness of at least about 0.2 centimeters (about 1/16 inch).

5. The suspenders of claim 1 wherein the padded connector has more padding as compared to any one of the first front strap portion, the second front strap portion, and the first and second rear strap portions.

6. The suspenders of claim 1 wherein the padded connector has a surface area of at least about sixteen square inches to about twenty five square inches.

7. The suspenders of claim 1 wherein the first front strap portion, the second front strap portion, and the first and second rear strap portions are fire resistant, are generally made of or include an elastic material, and each include a connector at the distal end thereof.

8. The suspenders of claim 1 wherein the first front strap portion, the second front strap portion, and the first and second rear strap portions are each made from a separate piece of material that is connected to the padded connector.

9. The suspender of claim 1 wherein the padded connector includes padding material selected from the group consisting of a foam, an elastic or polymeric material, air or air pockets, rubber, aramid materials, and combinations thereof.

10. A suspenders assembly comprising:

suspenders that comprise:

a generally U-shaped or V-shaped padded connector comprising a base portion having first and second legs extending therefrom, the first and second legs being configured to be located on respective shoulders of a wearer and the base portion being configured to lie on a back of a wearer and shaped and sized to align with the center of the back of the wearer when the suspenders are worn;

a first front strap portion coupled to the first leg of the padded connector;

a second front strap portion coupled to the second leg of the padded connector; and first and second rear strap portions coupled to the base portion of the padded connector, the first and second rear strap portions being spaced apart from and arranged generally parallel to each other when the suspenders are worn.

wherein the padded connector is padded by the inclusion of a padding material; and a pair of trousers, wherein the first front strap and the second front strap are attachable to a front portion of the trousers and the pair of rear straps are attachable to a rear portion of the trousers.

11. The suspenders of claim 10 wherein the padded connector includes a fire resistant material with an inner cavity having the padding material therein.

12. The suspenders of claim 10 wherein the padding material is attached to the padded connector.

13. The suspenders of claim 10 wherein the padded connector has a thickness of at least about 0.2 centimeters (about 1/16 inch).

14. The suspenders of claim 10 wherein the padded connector has more padding as compared to any one of the first front strap portion, the second front strap portion, and the first and second rear strap portions.

15. The suspenders of claim 10 wherein the padded connector has a surface area of at least about sixteen square inches to about twenty five square inches.

16. The suspenders of claim 10 wherein the first front strap portion, the second front strap portion, and the first and second rear strap portions are fire resistant, are generally made of or include an elastic material, and each include a connector at the distal end thereof.

17. The suspenders of claim 10 wherein the first front strap portion, the second front strap portion, and the first and second rear strap portions are each made from a separate piece of material that is connected to the padded connector.

18. The assembly of claim 10 wherein said trousers include an outer shell that is abrasion, flame and heat resistant such that the outer shell resists igniting, burning, melting, dripping or separation when exposed to a temperature of 500° F. for at least five minutes.

19. The assembly of claim 18 wherein said outer shell includes a material selected from a group of consisting of an aramid material, a blend of aramid materials, a polybenzamidazole material, and a blend of aramid and polybenzamidazole materials.

20. The assembly of claim 18 further comprising a moisture barrier located generally inside of said outer shell such that when said trousers are worn said moisture barrier is located generally between said outer shell and a wearer of said trousers, said moisture barrier being made of a material that is generally liquid impermeable and generally moisture vapor permeable.

21. The assembly of claim 18 further comprising a thermal liner located generally inside said outer shell such that when said trousers are worn said thermal liner is located generally between said outer shell and a wearer of said trousers, wherein said thermal liner has a thermal protection performance of at least about 20.

* * * * *